US005381917A

United States Patent [19]

Santagiuliana

[11] Patent Number: 5,381,917

[45] Date of Patent: Jan. 17, 1995

[54] PLASTIC SAFETY CAP

[75] Inventor: Evans Santagiuliana, Vicenza, Italy

[73] Assignee: Taplast SRL, Italy

[21] Appl. No.: 129,174

[22] PCT Filed: May 11, 1992

[86] PCT No.: PCT/EP92/01067

§ 371 Date: Oct. 7, 1993

§ 102(e) Date: Oct. 7, 1993

[87] PCT Pub. No.: WO92/21584

PCT Pub. Date: Dec. 10, 1992

[30] Foreign Application Priority Data

May 29, 1991 [IT] Italy ..... VI91A000093

[51] Int. Cl.[6] ..... B65D 55/02

[52] U.S. Cl. ..... 220/219; 220/220

[58] Field of Search ..... 215/219, 220, 221, 295, 215/305

[56] References Cited

U.S. PATENT DOCUMENTS

| | | | |
|---|---|---|---|
| 4,140,235 | 2/1979 | Rausing et al. | 215/305 |
| 4,410,098 | 10/1983 | Dubs et al. | 215/220 |
| 4,632,264 | 12/1986 | Evans | 215/220 |
| 4,669,620 | 6/1987 | Coifman | 215/220 |
| 4,705,181 | 11/1987 | Burke | 215/220 |
| 4,729,487 | 3/1988 | Wright | 215/219 |

FOREIGN PATENT DOCUMENTS

| | | | |
|---|---|---|---|
| 3605963 | 8/1987 | Germany | 215/220 |
| 371679 | 4/1932 | United Kingdom | 215/305 |

*Primary Examiner*—David T. Fidei

*Attorney, Agent, or Firm*—Watson, Cole, Grindle & Watson

[57] ABSTRACT

The invention discloses a cap with a safety opening which comprises an inner element (10) with a thread suited to be screwed on the neck of a bottle (40), presenting on its outer cylindrical surface cogs (13) matching the corresponding cogs (31) which are present on an outer element (30), an outer element (30), also essentially cylindrical, presenting a double row of cogs (31, 33), co-operating with the inner element (10) and with a push-button (20); a push-button (20) having an essentially cylindrical shape and being placed between the inner and the outer elements and presenting at its bottom an annular rim (24) with a double row of cogs (21, 25), one row being arranged on its cylindrical wall and the other on the vertical wall (26) of the annular rim (24). When the push-button (20) is pressed downwards and slightly rotated in the direction for untightening the cap, the cogs (21) of said push-button engage the corresponding cogs (15) belonging to the inner element (10) thereby maintaining the push-button integral with said inner element until the outer element (30) is rotated in the direction for tightening the cap.

7 Claims, 3 Drawing Sheets

PLASTIC SAFETY CAP

BACKGROUND OF THE INVENTION

The invention discloses a safety cap made of plastic material, particularly suited to be applied on bottles containing medicines or other potentially dangerous substances. The cap according to the invention belongs to the type of caps, which are usually called "child-proof", i.e. those caps which, in order to be unscrewed, need the logical co-ordination of certain movements. In other words, said movements can only be voluntarily performed by persons who are perfectly aware of what they are doing.

Some safety caps are known, consisting for instance of two elements, wherein the inner element is screwed on to the cap and the outer element is co-axial with the inner element and is connected with it. With this type of cap, the tightening action is always possible, while the unscrewing action, which gives access to the bottle's content, is only possible if pressure is applied axially to the outer element against the inner element and the cap is unscrewed at the same time. Generally, these types of caps present the inconvenience that the bottles suited to receive them must present an indented ring around the neck, so that a seal can be applied on the bottle and this complicates the manufacture of the bottle itself, because of the presence of undercuts. Moreover, it must be underlined that the safety of the cap is fairly limited, since it is possible that the opening action may be performed by unauthorized persons through the involuntary but co-ordinated actions of axial pressure and simultaneous unscrewing.

The European Patent EP 0 184 795 has been registered in the name of the author of the present invention. This patent overcame the above-mentioned inconveniences by disclosing a cap consisting essentially of three parts, i.e. of an inner element screwed on to the neck of the bottle, of an outer cylindrical element co-axial with the inner element and of a push button placed between the inner and the outer elements. The presence of suitable cogs between the outer and the inner elements allows the caps to be tightened around the bottle under any circumstance, while the untightening of this cap is only made possible by pressing the push-button placed between the outer cylindrical element and the inner one and by simultaneously untightening the outer element. This is made possible by the fact that the pressure of the push-button against the bottle causes the rigid connection between the inner and the outer elements, so that the untightening of the latter element drags also the inner element.

Although this previous cap grants an optimum degree of safety, it has been noticed that it can be fairly difficult even for persons who are able to use this type of caps to untighten this cap while keeping constantly depressed the push-button connecting the outer element with the inner element, particularly if the cap is screwed very tightly around the container.

SUMMARY OF THE INVENTION

The present invention has the purpose of overcoming the just-mentioned inconveniences. In other words, it discloses a safety cap, which, although in order to be untightened from the bottle, it needs the co-ordination of some non-trivial movements, can also be easily handled and, therefore, does not cause any problem to the skilled user.

In the substance, the purpose of the present invention is that of disclosing a cap, wherein the co-ordinated movements must be performed in a logical sequence, but do not occur simultaneously, so as to avoid the complicated and difficult engagement of the fingers of the same hand.

Another proposed purpose is that of simplifying the manufacturing process of the cap by reducing its volume, its weight and, as a consequence, its overall dimensions, the dimensions of the bottle to be sealed remaining unchanged. Not the least proposed purpose is the disclosure of a cap whose handling is improved in relation to the known cap. All the mentioned purposes and others which will be better illustrated hereinafter are fulfilled by a cap with a safety opening which, in accordance with the main claim, comprises:

an inner element having an essentially cylindrical shape, its inner wall being threaded and suited to be screwed on to the threaded neck of a bottle and its outer wall presenting cogs which match the corresponding cogs of an outer element co-operating with said inner element, the upper part of said inner element presenting a central part in the shape of an upwardly protruding truncated cone and axially protruding cogs on its upper surface;

an outer element also having an essentially cylindrical shape and presenting on its inner wall a double row of cogs, one row co-operating with the cogs belonging to the inner element and the other row co-operating with the cogs of a push-button placed between said outer element and said inner element;

a push-button having an essentially cylindrical shape and being placed between the outer element and the inner element, arranged co-axially in relation to said inner element by means of elastic tabs arranged on the generating lines of a cylinder and interacting with a corresponding tapered surface of the truncated cone, said push-button presenting at its bottom a wider annular rim having a double row of cogs, one row being arranged on the cylindrical wall and engaging in any direction the corresponding cogs which are present on the cylindrical inner wall of the outer element, while the other row is arranged on the lower axial end of the vertical wall of the annular rim, characterized in that, when said push-button is pushed downwards and rotated in the direction for untightening the cap, the cogs of the other row arranged in a slanted position on the annular wall of the vertical rim of said mush-button engage the corresponding slanted radial axially protruding cogs which are present on the upper part of the inner element, said two rows of matching cogs keeping the push-button and the inner element rigidly connected with each other against relative axial displacement as long as the outer element of said cap rotates in the untightening direction.

According to the invention the inner element is screwed on the bottle by means of a suited thread which is present on its inner wall; moreover, said inner element presents on its outer cylindrical surface two or more cogs co-operating with another row of cogs which is present on the inner surface of the outer element matching said inner element and being co-axial with it. The cogs are arranged so that they engage each other only when the cap is being tightened, while they slip on each other when the outer element rotates in the untightening direction.

The push-button is the element connecting the outer element with the inner element and it is always dragged by the outer element, both during the tightening and the untightening operations, but, as has been said, the push-button rigidly connects the outer and the inner elements only when it is pushed downwards and its cogs engage the corresponding cogs belonging to the inner element.

The perfecting of the invention described in Patent EP 0 184 795 consists in that the axial downward pressure of the push-button and a slight rotation of the same in the untightening direction allow the cogs whose profile is slanted in relation to the vertical line, which are present on said push-button, to engage the corresponding, also slanted cogs, which are present on the upper surface of the inner element so that the push-button is forced to maintain its position of engagement with the inner element. Because of this effect, after the push-button has been pushed downwards and in the untightening direction, the hand can proceed directly to the untightening of the cap by acting only on the outer element, since it is no longer necessary to keep the finger pressed on the push-button, in order to keep it depressed.

The advantage obtained with the perfecting of the invention is obvious, since although the movements must be in a co-ordinated succession, they are separate from each other, so that it becomes easier for the operator to handle the cap, particularly when the same is tightly screwed on the container.

DESCRIPTION OF THE DRAWINGS

Further scope of applicability of the present invention will become apparent from the detailed description given hereinafter. However, it should be understood that the detailed description and the specific example, while indicating a preferred embodiment of the invention, are given by way of illustration only, since various changes and modifications within the spirit and scope of the invention will become apparent to those skilled in the art from this detailed description and from the drawings, wherein.

DESCRIPTION OF THE INVENTION

Figure 3:
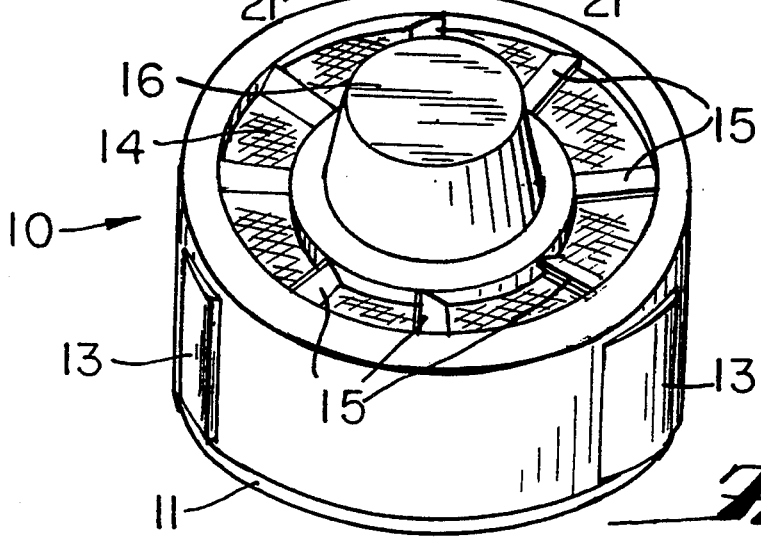
FIG. 3 is a perspective view of the inner element of the cap which is screwed on the bottle.
Figure 4:
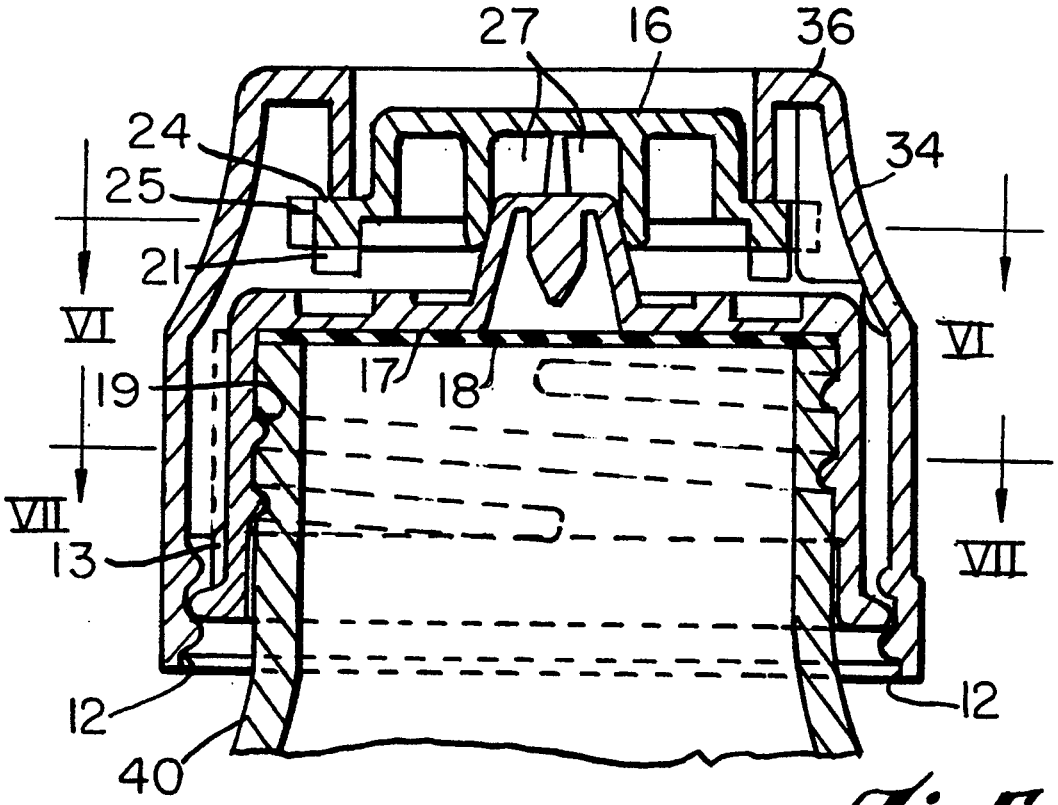
FIG. 4 is a cross-section representation of the cap with the push-button in its upward position and not engaging the inner element.
Figure 5:
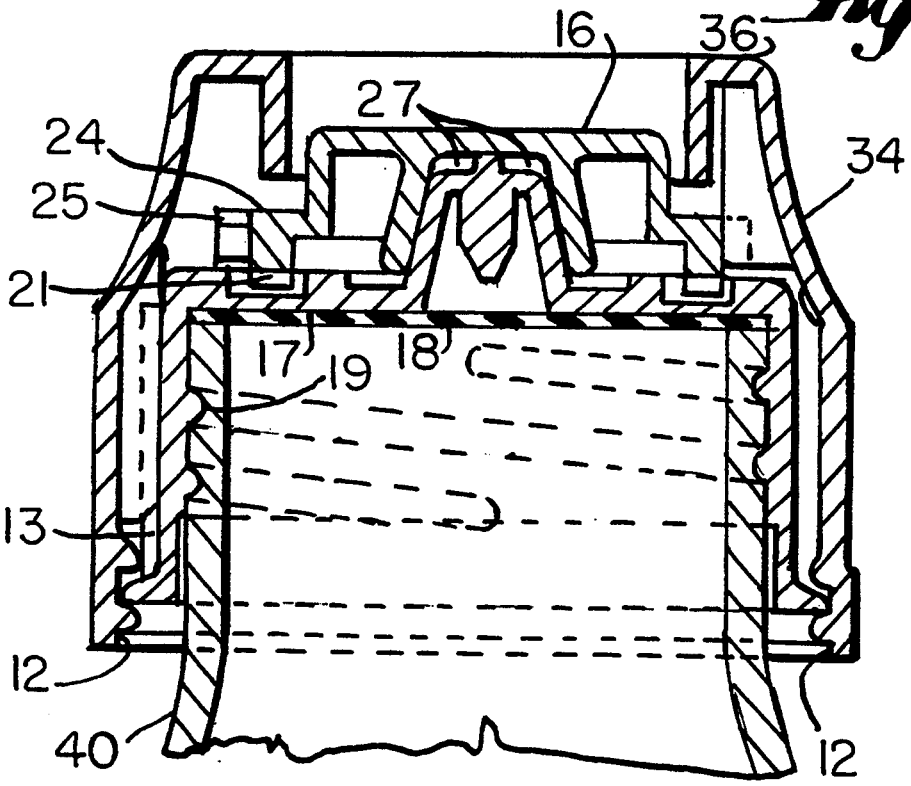
FIG. 5 is a cross-section representation of the cap of the invention with the push-button engaging the inner element.
Figure 6:
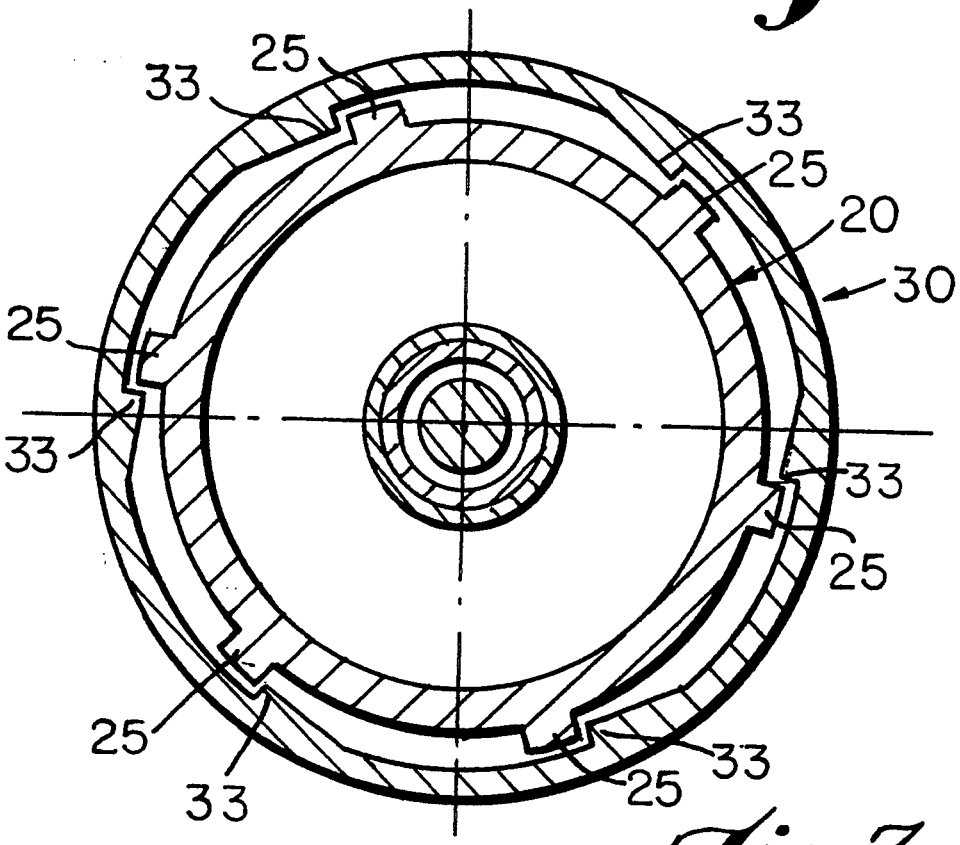
FIG. 6 is a cross-section view of FIG. 4 along the VI—VI line.
Figure 7:
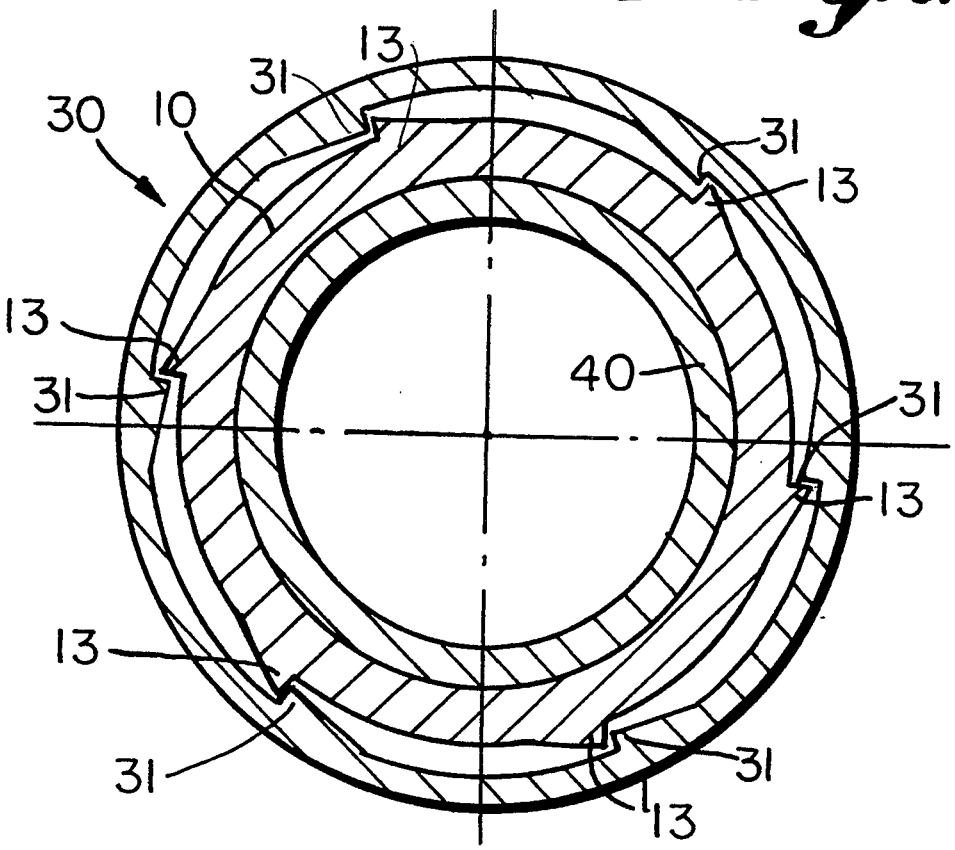
FIG. 7 is a cross-section view of FIG. 4 along the VII—VII line.

With reference to the FIGS. 3 and 4, they represent the inner element of the cap, which is indicated as a whole with 10, and which is complete with a thread 19, matching the corresponding thread on the bottle neck 40. Element 10 is made of plastic, it has an essentially cylindrical shape and it ends at the bottom with a protruding and annular rim 11 which matches a corresponding seat 12, which is present on the inner surface of the outer element 30. The outer surface of the cylindrical part of the inner element 10 presents a row of cogs 13, having an essentially triangular profile, which are clearly visible in FIG. 3 and in the cross-section of FIG. 7. Element 10 presents at its top a circular crown 14, on which the cogs 15 are obtained by moulding and are arranged radially and slanted in relation to the surface 14, their inclination being such, that when the cap is rotated in the unscrewing direction, the cogs 15 engage the corresponding cogs 21 having a matching profile and belonging to the push-button 20, which will be described further on.

The inner element 10 presents in the middle of its top a body in the shape of a truncated cone 16 which, as will be described further on, acts as an elastically repulsing agent by co-operating with the inner element. The bottom face 17 of the top surface of cap 10 is essentially flat and it is suited to receive a gasket 18 which seals element 10 in relation to the opening of bottle 40.

As has been pointed out earlier the presence of the cogs 13 on the outer surface of the cylindrical part of the inner element 10 insures the tightening of the inner cap on the bottle, when the outer element 30 is rotated in the tightening direction and that is possible because the cogs 13 engage the corresponding cogs 31 belonging to the outer element 30. The cogs 31 are arranged on the inner surface 32 of the outer element 30 and they only engage the corresponding cogs 13 when the tightening operation is performed. When, on the other hand, the cap is rotated in the untightening direction, the cogs 31 slip over the cogs 13 and they prevent the inner element from being dragged by the outer element 30, unless the connection between the outer element 30 and the inner element 10 is achieved by means of the push-button 20.

Figure 2:
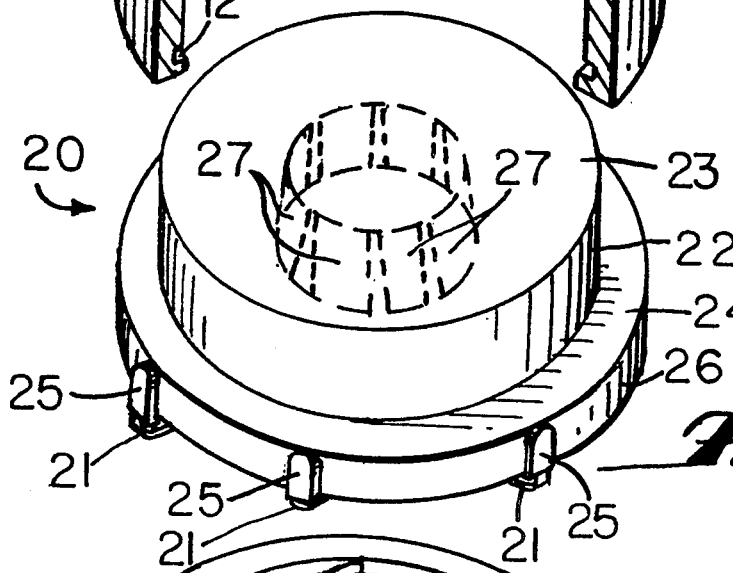
FIG. 2 is a perspective view of the push-button of the cap.

As can be observed in FIG. 2, the push-button 20 presents a main cylindrical body 22 with a flat surface 23 and a bottom annular rim 24 protruding from the cylindrical body 22, on which two rows of cogs are arranged: the cogs 21 which have already been mentioned and which are arranged on the lower vertical surface of the annular rim and the cogs 25 which, on the contrary, are arranged on the cylindrical wall 26 of the annular rim 24. The cogs 25 engage the corresponding cogs 33 belonging to the outer element 30, both when this is rotated in the tightening and in the untightening direction, while, as has been mentioned earlier, the cogs 21, having a slanted profile and being arranged on the vertical surface of the annular rim, engage the corresponding cogs 15 having a matching profile, when the push-button 20 is pushed downward and rotated in the untightening direction of the cap. A set of elastic tabs 27 protruding downwards from the flat surface 23, are arranged on the surfaces of a cylinder and snap elastically into the tapered surface 16 and they co-operate elastically with the tapered surface 16 of the inner element 10 when the push-button 20 is pressed downwards. It is easy to understand that, whenever the cogs 21 and 15 engage each other, the elastic action of the tabs 27, which tends to push upwards the push-button 20 because of the contrast against the tapered element 16, determines the engagement of the cogs 21 with the cogs 15 and, therefore, their rigid connection. Under these conditions, it will be pointed out again that, since the outer element 30 interacts with the push-button 20 by means of its cogs 33 through the cogs 25 belonging to said push-button 20, it will follow that each rotating motion of the outer element 30 is transmitted to the push-button 20 in the same direction. If said push-button is made integral with the inner element 10 through the connection of its cogs 21 and the cogs 15, it follows that each motion of the outer element 30 is transmitted to the inner element 10. Therefore, by depressing the push-button 20 and by slightly rotating it in the untightening direction, so as to force the cogs 21 to hook on to the cogs 15 of the inner element 10, it is possible to unscrew the cap without it being necessary to maintain the push-button 20 constantly depressed. This is possible thanks to the fact that the cogs 21 and 15 are made integral with each other and they remain so until the tightening operation disconnects them again and brings the push-button upwards again because of the elastic reaction of the tabs 27 on the tapered surface. It has, therefore, been seen that with the cap according to the invention it is possible to perform logically and sequentially the two operations, one concerning the depression and the rotation of the push-button, the other one the actual untightening of the outer element 30, without it being necessary to keep the fingers pressed on the push-button.

Figure 1:
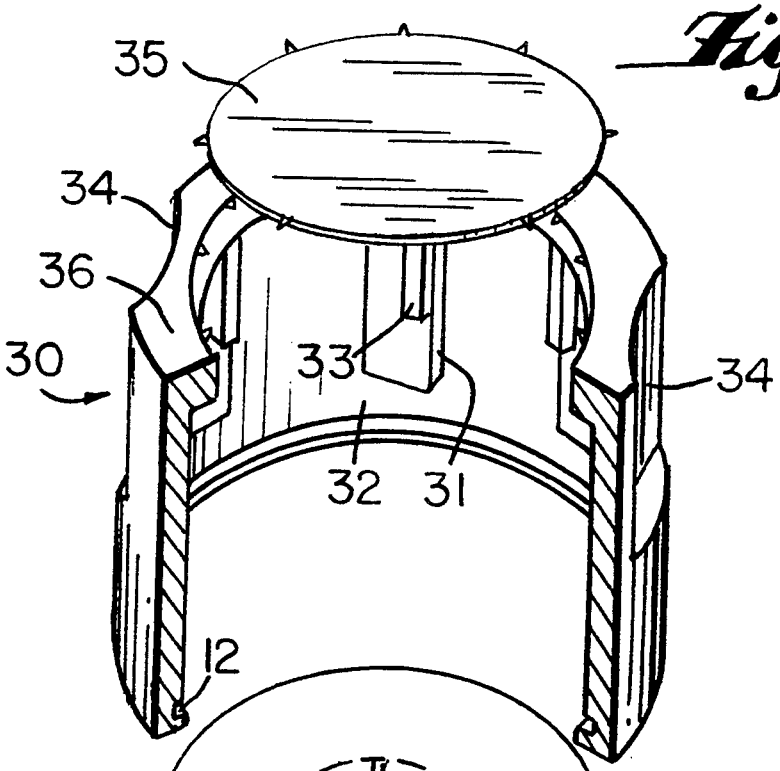
FIG. 1 is a partially cutaway, perspective view of the outer element of the cap.

In order to make the tightening and untightening operations easier to perform, the cap of the invention, in the embodiment represented in FIG. 1, presents two functional symmetrical depressions 34, in which the fingers rest during the tightening and untightening operations. Moreover, the top of the outer element 30 is provided with a seal 35, which is connected by means of small plastic tabs with the rim 36 of the outer element 30; the seal is torn when one wants to have access to the push-button 20 which is placed underneath said seal.

It will be pointed out that because the cogs 15 have been obtained within the thickness of the upper surface of the cap of the inner element 10, it has been possible to lower the total height of the cap according to the invention with the ensuing advantages both concerning the cost and the aesthetic and the functional aspects.

Obviously, the cap according to the invention may undergo variations and changes during the manufacturing process, concerning, for instance, its shape, the number of its cogs on the lateral surfaces of the inner element 10 or outer element 30, or the shape or the number of cogs on the flat surface of the push-button and of the inner element, as well as any other functional element, but said changes and variations will not exceed the spirit and the scope of the present invention, such as they are listed and described in the following claims.

I claim:

1. A cap with a safety opening for engaging the threaded neck of a bottle comprising:

an inner element having a cylindrical shape, including a threaded inner wall suited to be screwed onto the threaded neck of the bottle and an outer wall being formed with a plurality first axial cogs on said outer wall, each having a surface operable for engagement in a direction of screwing the cap, said inner element having an upper wall including a central portion having a shape in the form of an upstanding partially truncated cone said upper wall being formed with a plurality of first radial cogs facing outwardly each having a slanted surface;

an outer element having a cylindrical shape including an inner wall formed with a plurality of second and third axial elongated cogs, the second axial cogs being adjacent to the inner wall and cooperating with the first cogs on the outer wall of the inner element in the direction of screwing on the cap and being longer than the third axial cogs;

a push-button having a cylindrical shape and being located between the outer element and the inner element and arranged co-axially in relation to said inner element, and including a top portion formed with an inner surface including elastic tabs arranged on the generating lines of a cylinder for engaging the upwardly facing central portion of the inner element, said push-button having a radially extending annular rim formed with a plurality of second radial cogs and a row of fourth axial cogs, said fourth axial cogs being arranged for engaging in any direction the first axial cogs on the cylindrical inner wall of the outer element, the second radial cogs each having a slanted surface for engaging the corresponding slanted surface on the outwardly facing first radial cogs on the upper wall of the inner element when said push-button is pushed downwards and rotated in the direction for untightening the cap, said second radial cogs on the push-button and the outwardly facing first radial cogs on the inner member cooperating for maintaining the push-button and the inner element connected with each other as long as the outer element of said cap rotates in the untightening direction and the outer member is engaged towards the inner member against the elastic tabs.

2. The safety cap of claim 1 wherein said inner element includes an outer rim and the outwardly facing first radial cogs are arranged radially in a circular crown between the annular rim of said inner element and the central portion, said first radial cogs being formed substantially within a thickness of the upper wall of the inner element.

3. The safety cap according to claim 1, wherein the outer element and the inner element are reciprocally rotatable.

4. The safety cap of claim 3 wherein a lower marginal edge of the inner element is formed with an outwardly extending annular projection.

5. A safety cap according to claim 1 wherein the upper surface of the inner element has a bottom face for engaging on the bottle and is adapted to receive a gasket or seal.

6. A safety cap according to claim 1 wherein the outer member is formed with at least two indentations on its outer surface suited to engage fingers of the hand of a user during the unscrewing.

7. The safety cap of claim 5 wherein a lower margin of the inner wall of the outer element is formed with a corresponding annular indentation mating with the annular project on the inner element.

* * * * *